US006027383A

United States Patent [19]

Broinowski

[11] Patent Number: 6,027,383

[45] **Date of Patent: *Feb. 22, 2000**

[54] MARINE DUCTED PROPELLER JET PROPULSION UNIT

[76] Inventor: Stefan Broinowski, c/o Advance Marine Technology, Inc., 132 Water St., East Norwalk, Conn. 06854

[ * ] Notice: This patent is subject to a terminal disclaimer.

[21] Appl. No.: 08/290,992

[22] PCT Filed: Feb. 27, 1992

[86] PCT No.: PCT/AU92/00085

§ 371 Date: Aug. 21, 1995

§ 102(e) Date: Aug. 21, 1995

[87] PCT Pub. No.: WO93/16915

PCT Pub. Date: Sep. 2, 1993

Related U.S. Application Data

[63] Continuation-in-part of application No. 07/521,696, May 10, 1990, Pat. No. 5,123,867.

[51] Int. Cl.[7] ..... B63H 11/00

[52] U.S. Cl. ..... 440/38; 440/47

[58] Field of Search ..... 440/38–42, 47, 440/46, 88; 60/221, 222; 415/118

[56] References Cited

U.S. PATENT DOCUMENTS

| | | | |
|---|---|---|---|
| 3,083,529 | 4/1963 | Hamilton | 60/221 |
| 3,187,708 | 6/1965 | Fox . | |
| 3,192,715 | 7/1965 | Engel et al. . | |
| 3,233,573 | 2/1966 | Hamilton . | |
| 3,251,185 | 5/1966 | Aschauer | 440/40 |
| 3,279,704 | 10/1966 | Englehart et al. | 440/47 |
| 3,302,605 | 2/1967 | Kuether . | |
| 3,328,961 | 7/1967 | Aschauer | 440/47 |
| 3,543,713 | 12/1970 | Slade . | |
| 3,589,080 | 6/1971 | Shields . | |
| 3,589,325 | 6/1971 | Tattersall . | |
| 3,620,019 | 11/1971 | Munte . | |
| 3,624,737 | 11/1971 | Keller . | |
| 3,680,315 | 8/1972 | Aschauer et al. . | |
| 3,776,173 | 12/1973 | Horwitz . | |
| 3,782,320 | 1/1974 | Groves, Jr. . | |
| 3,788,265 | 1/1974 | Moore . | |
| 3,827,290 | 8/1974 | De Vault et al. . | |
| 3,842,787 | 10/1974 | Giacosa . | |
| 3,868,833 | 3/1975 | Noe et al. | 440/38 |
| 3,889,623 | 6/1975 | Arnold . | |
| 3,993,015 | 11/1976 | Klepacz et al. . | |
| 4,051,801 | 10/1977 | Woodfill et al. | 440/42 |
| 4,133,284 | 1/1979 | Holcroft . | |
| 4,182,118 | 1/1980 | Chronic | 440/47 |
| 4,432,736 | 2/1984 | Parramore . | |
| 4,449,994 | 5/1984 | Baker et al. . | |
| 4,474,561 | 10/1984 | Haglung . | |
| 4,600,394 | 7/1986 | Dritz . | |
| 4,643,685 | 2/1987 | Nishida . | |
| 4,652,244 | 3/1987 | Drury . | |
| 4,718,870 | 1/1988 | Watts . | |
| 4,925,408 | 5/1990 | Webb et al. . | |

*Primary Examiner*—Ed Swinehart
*Attorney, Agent, or Firm*—Daniel N. Lundeen

[57] ABSTRACT

A tunnel jet propulsion unit (11) for marine craft, wherein the passing water mass in the tunnel is converged by decreasing the cross-section flow area of the tunnel. The unit (11) comprises an intake section (1); an impeller section comprising a cylindrical housing (31), a rotatable hub (34) and a plurality of a radially spaced impeller blades (36); a diffuser section comprising an inwardly tapered inside surface (39), a fixed hub (38) and a plurality of radially spaced diffuser blades (40); discharge section (D); a bearing between the hubs (34) and (38); and means for rotating the rotatable hub (34). Additional features include anti-balling by-pass valve (172) positioned upstream from the impeller (33) to relieve excessive water pressure on the hull if unit (11) handling capcity is exceeded and a trim adjusting machanism in the discharge section (D) for adjusting the height of the unit outlet (30) with respect to the water surface. Also a nozzle (21) having a variable outlet orifice can be used to fine tune performance.

24 Claims, 6 Drawing Sheets

104
102
100
103
32
12
154
152
150
22
24
12

66
24
108
110
4
104
102
106
107
4
100
11
140
146
32
5
5
12
150

11
24
12
78
73
74
72
80
66
154
155
32
103
152
22
150
156
153
176

MARINE DUCTED PROPELLER JET PROPULSION UNIT

CROSS REFERENCE TO PREVIOUS APPLICATIONS

The present application claims priority to PCT Application Ser. No. AU92/00085, filed Feb. 27, 1992 and is a continuation-in-part of U.S. Ser. No. 07/521,696, filed May 5, 1990, now U.S. Pat. No. 5,123,867 issued Jun. 23, 1992.

FIELD OF THE INVENTION

The present invention is directed to a marine ducted propeller jet propulsion apparatus, and more particularly to an impeller assembly and ducted design for a marine ducted propeller jet propulsion unit.

BACKGROUND OF THE INVENTION

The use of jet propulsion devices for marine craft is well known technology. Jet propulsion has many advantages over the simple propeller, particularly in terms of maneuverability, and jet propulsion energy consumption is much more efficient. However, widespread acceptance of jet propulsion for marine craft has not occurred because of certain common problems associated with marine jet propulsion. For example, marine jet propulsion poses significant design problems because of uncertain performance over a wide range of speeds, water depth, sea conditions, etc.

Excess water pickup at the jet propulsion unit inlet may cause balling, i.e., excess water pressure between the hull and the inlet because the unit is not able to intake a sufficient volume of water during craft maneuvers or poor sea conditions. Balling induces a high drag characteristic adversely affecting the propulsive efficiency.

Cavitation is another common problem. Cavitation represents an uneven load on the impeller. Cavitation can be produced by excessive radial acceleration of the fluid, excess swirl and turbulence of the fluid column, and unintentional partial vaporization of the fluid throughput associated with a vacuum produced by impeller action.

Accordingly, it would be desirable to design a jet propulsion unit for marine vessels where each feature synergistically works together to provide for a constant column of water even at high output and where the water throughput is neither turbulent nor swirling in order to eliminate cavitation effects. Furthermore, the unit should have maximum flexibility to cope with the entire speed range of the marine vessel and varying loading on the unit without producing the above-mentioned balling and cavitation effects.

Finally, the unit ought to be efficient at preventing intake of foreign matter, yet have provided therefor a quick means for manually cleaning the intake if fouling occurs.

U.S. Pat. No. 4,449,944 to Baker et al. discloses a variable inlet device for a hydrojet boat drive permitting efficient transition from low to high speed operation of the boat. Installed in the "slot" of a "V" bottomed hull, the drive features a low drag ram-scoop with a blow-in door or panel which is responsive to imbalance between internal flow pressure and external slipstream pressure.

U.S. Pat. No. 3,543,713 to Slade discloses a propulsion unit for a marine vessel which operates by discharging water from a pump through an orifice. The orifice can be directed in accordance with the desired direction of propulsion.

U.S. Pat. No. 3,680,315 to Aschauer et al. discloses a hydraulic jet propulsion apparatus for boats having a variable area discharge nozzle.

Australian Patent Application 24907/88, filed Nov. 1, 1988 and opened to public inspection May 11, 1989, discloses a marine propulsion unit comprising a housing with a variable inlet induction, first set of vanes downstream of said induction, a propeller/impeller, a second set of vanes downstream of said propeller and a convergent discharge housing downstream of said second set of vanes. The use of a variable inlet orifice induction is said to reduce choking within the induction, and therefore cavitation and drag. The marine propulsion unit may be used with either outboard or sterndrive power trains.

U.S. Pat. No. 3,302,605 to Kuether discloses a jet propulsion apparatus for water craft which possesses a steering mechanism said to provide increased maneuverability and a structure of propeller and housing said to operate efficiently and requiring a minimum amount of power.

U.S. Pat. No. 3,187,708 to Fox discloses a jet propulsion unit for boats entirely outside of the hull that supplants the gear box propeller and rudder structure of the usual power boat arrangements.

U.S. Pat. No. 3,993,015 to Klepacz et al. discloses a hydraulic propulsion system for watercraft involving the forming of a parallel-sided, open-ended intake tunnel.

Other U.S. Pat. Nos. of interest include 3,889,623 to Arnold; 3,827,390 to De Vault et al.; 3,233,573 to Hamilton; 4,133,284 to Holcroft; 3,868,833 to Noe et al.; 4,652,244 to Drury; 3,192,715 to Engel et al.; 3,598,080 to Shields; 3,620,019 to Munte; 3,842,787 to Giacosa; 3,624,737 to Keller; 4,718,870 to Watts; 4,643,685 to Nishida; 4,600,394 to Dritz; 3,782,320 to Groves Jr.; 3,776,173 to Horwitz; 3,589,325 to Tattersall; 4,432,736 to Parramore; 3,788,265 to Moore; 4,474,561 to Haglung; and 4,925,408 to Webb et al.

SUMMARY OF THE INVENTION

The present invention provides a ducted propeller jet propulsion unit for disposition in the rear of marine craft to be propelled. The unit includes a ducted having nozzle flow characteristics on a volumetric basis and a complementary impeller assembly enabling the unit to operate over a wide variety of conditions associated with speed variation, maneuverability, and sea conditions without cavitation or balling. Additional features include an anti-balling bypass valve for relieving excessive pressure in the intake and a trim adjustment mechanism.

The ducted propeller marine propulsion unit comprises a duct forming a continuously converging passage on a volumetric basis from an inlet opening to a discharge nozzle so that water flow received at the inlet is focused at the nozzle into a low turbulence water vector. An energy imparting impeller concentrically disposed in the duct and with a concentric rotatable hub forming a first annular passage therein, comprises impeller blades radially spaced on the hub wherein a volumetric displacement of the impeller converges the flow through the first annular passage. A flow-straightening stator or confusor concentrically disposed in the duct adjacent the impeller and forming a second annular passage comprises a fixed hub having radially spaced confusor vanes wherein a volumetric displacement of the confusor converges the flow through the second annular passage. As used in the present specification and claims, applicant uses the word "confusor" to mean a stator for focusing or convergence of flow from low to high velocity during the flow straightening process, rather than the typically used "diffuser" which generally connotes a diffusion and velocity reduction in the fluid flow. As used in the present specification and claims, applicant uses the phrase "radially spaced" to mean that the blades or vanes are rotated about a common axis of rotation at different angles with respect to each other.

The entire system provides a low resistance flow passage where internal impediments to flow are reduced and the convergent sections are smooth and gradual.

DETAILED DESCRIPTION OF THE INVENTION

The present invention is based in part on the discovery that substantially enhanced propulsive efficiency can be obtained by converging the passing water mass on a volumetric basis as exhibited by fluid flow through a nozzle. Or, in other words, the axial cross-sectional flow area substantially regularly decreases from the inlet to the outlet. Use of volumetric nozzle design in the present invention reduces turbulence and enhances plug-flow character of the water stream.

Figure 1:
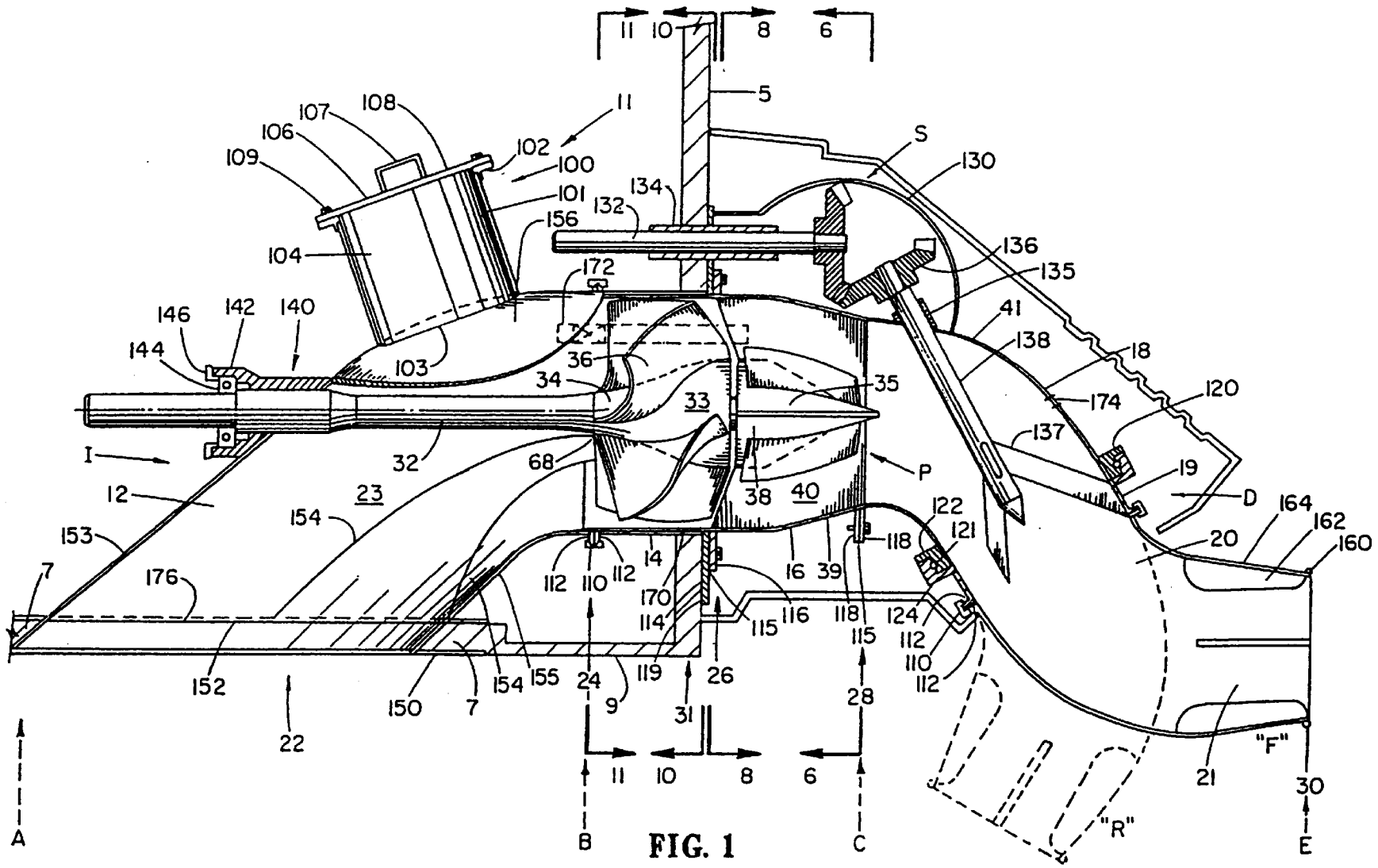
FIG. 1 is a longitudinal cross-section partially cut away showing the ducted propeller jet propulsion unit within the confines of a marine vessel in forward thrust position and reverse thrust position.
Figure 2:
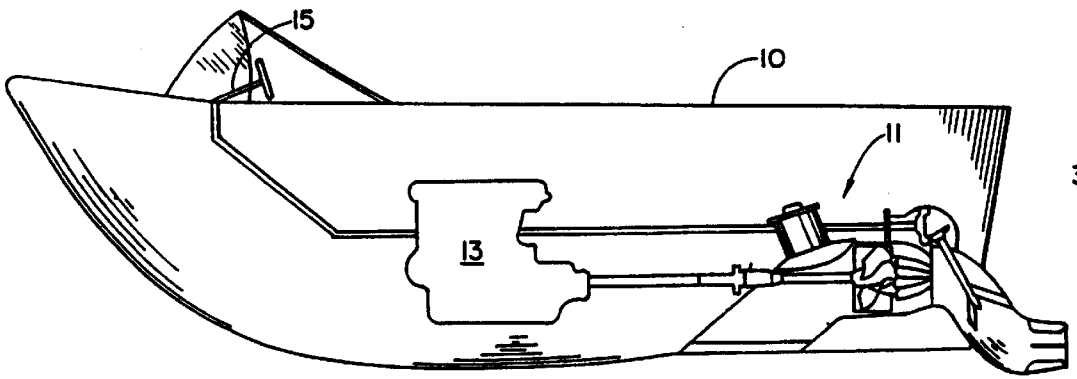
FIG. 2 is a representational view of the ducted propeller jet propulsion unit of the present invention from FIG. 1 in position in a marine craft.

Referring to FIGS. 1–2, the unit 11 functions similarly to an axial flow or turbine pump having an intake section I extending between lines A—A to B—B, an impeller section P extending between lines B—B to C—C and a discharge section D between lines C—C to E—E. A water column induced into inlet passage 23 is energized and accelerated through the discharge section to provide thrust for craft 10.

The marine craft 10 has the ducted propeller jet propulsion unit 11 installed in a rear section so that the intake section I of the unit 11 is incorporated into the bottom hull 9 between mounting blocks 7 and the discharge section D of the unit 11, supported by transom 5, extends out the rear of the boat in place of an ordinary impeller. The unit 11 is shown diagrammatically in two of its thrust positions: F—the forward propulsion position and R—the reverse propulsion position. A prime mover 13 is directly attached to an impeller shaft 32 and a steering linkage 15 is attached to the steering means S of the propulsion unit 11.

Figures 3, 4, 5:
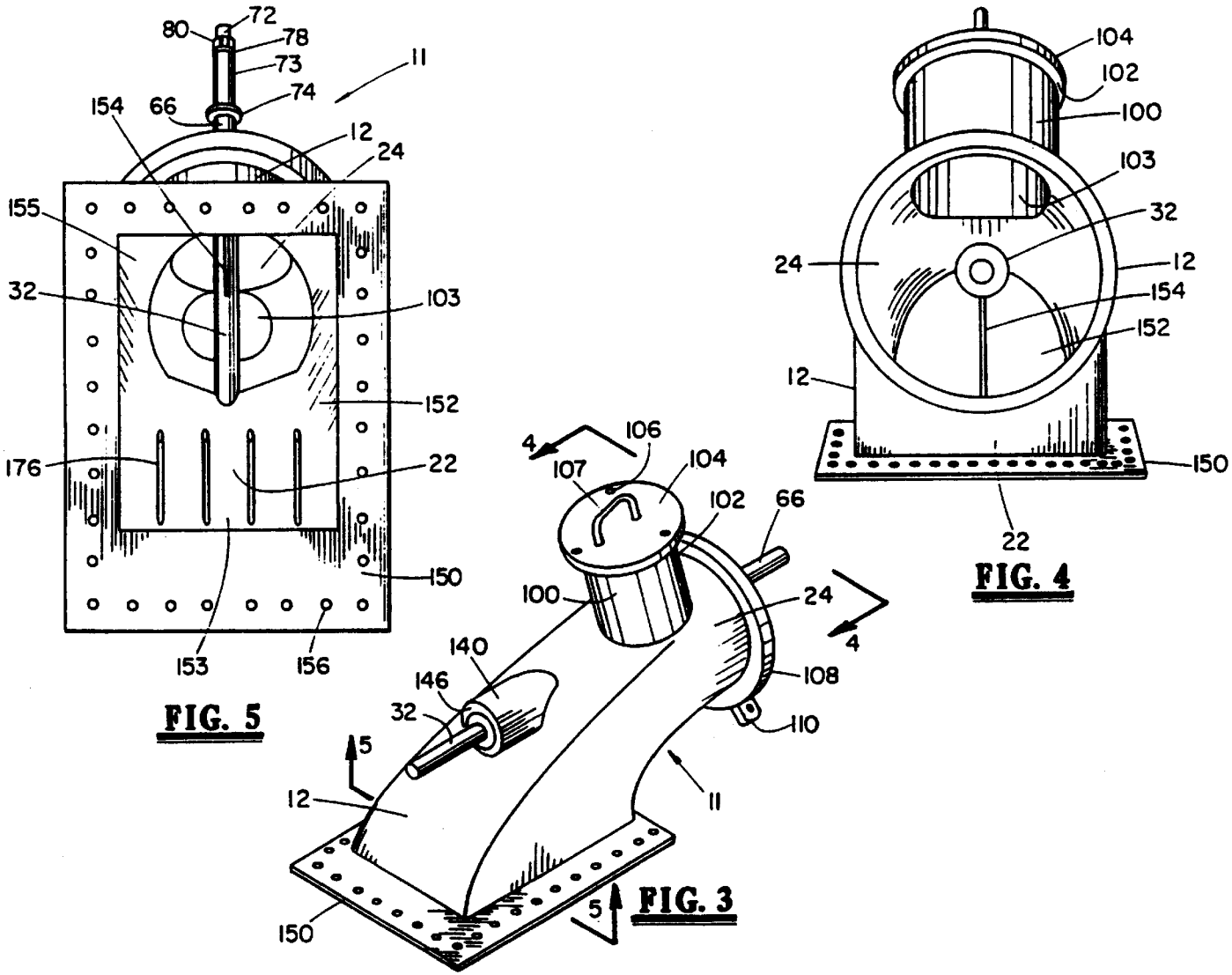
FIG. 3 is an angled exterior perspective view of the intake section of the jet propulsion unit of the present invention.
FIG. 4 is a front perspective view of the unit of FIG. 3 along the lines 4—4.
FIG. 5 is a bottom perspective view of the intake section of the jet propulsion unit of FIG. 3 from along the lines 5–5.

Referring to FIGS. 1, 4 and 5, the intake section I more particularly defines an intake passage 23 in a housing 12 communicating between an intake opening 22 formed in the bottom surface of the hull at one end, and the intake 24 to the impeller section P at the other end. Passage 23, initially rectangular, has two vertical walls 152, a long sloping wall 153, and a short sloping wall 155 converging onto a cylindrical chamber at bend 156. Following bend 156, passage 23 is cylindrical. Converging walls of the passage 22 are suitably smoothed and rounded at places of intersection to facilitate flow without turbulence. Typically, the angle of bend 156 varies from about 40 to about 45 degrees depending on a specific design requirement. The cross-sectional area of intake 22 is preferably proportional to the cross-sectional area at inlet 24 to an impeller 33 at a ratio varying from about 1.5 to about 2.5:1.

Situated along the intake walls of inlet housing 12 are one or more straightener vanes 154. Directional vanes 154 are spaced radially along the surface of inlet housing 12 so that equal volumes of water may be directed to the periphery of the impeller 33. Vanes 154 minimize radial loads on the impeller 33 for optimized flow efficiency. The vanes 154 also act to dampen any preliminary swirling and turbulence in the inlet water column.

Within passage 23 an intake grill 176 is disposed adjacent the hull opening 22 as seen in FIG. 5, Grill 176 is typically a span of parallel bars disposed lengthwise of the hull 9. The bars of grill 176 have streamlined or hydrofoil cross-section in the direction of the incoming stream to create minimal resistance to water flow. The spacing between bars of grill 176 should preferably not exceed the spacing between diffuser vanes 40 to prevent large objects which cannot pass through the unit 11 from entering.

If fouling inside housing 12 occurs, an arm-hole pipe 100 is provided to enable quick access to passage 23. Pipe 100 is situated at bend 156 and comprises a cylindrical housing 101, with an outer flange 102 and a plug 106. Plug 106 is provided with a solid section 104 affixed to a flanged cover 108 which completely fills pipe housing 101. Section 104 is provided with a smooth contoured surface 103 that matches the surface section removed from housing 12 in bend 156 when pipe 100 is installed. Pipe 100, when properly plugged poses essentially no additional resistance to flow or a region of flow disruption. Flange 102 is provided upstanding threaded bolts 109 which are inserted into bolt holes in flange 108 so that plug 106 may be properly aligned when installed. Handle 107 attached to cover 106 provides additional alignment indicia.

A preferred feature of the present invention is a bypass valve assembly 172 fitted in housing 12 near inlet 24 shown in FIG. 1. Excess water is bled through bypass valve assembly 172 if water pressure between the hull of the vessel 10 and the induction inlet 22 exceeds handling capacity. Excess water buildup known colloquially as balling is a common occurrence in marine jet propulsion units. Occurring at high vessel speeds when the vessel is undergoing sharp maneuvers and/or during rough sea conditions, balling introduces a high drag characteristic upon the hull of vessel 10 and affects the propulsive efficiency of unit 11. The valve assembly 172 functions as an anti-balling device to relieve pressure associated therewith.

The inlet section I is installed in the rear section of the hull so that forward motion o the vessel and subsequent elevation off the surface of the water enables the intake section I to be positioned slightly below the water level of the craft hull. However, for proper operation so that at a rest or at low speed, the unit should be installed so that at least about 60 to 70 percent of impeller 33 cross-sectional area is submerged. Intake section I is bolted, for example, to the hull by means of flange 150.

The impeller section P of the present invention, as seen in FIG. 1, from line A—A to line B—B is shown to incorporate a single stage impeller. The impeller assembly comprises a removable housing 31 made up of two smaller sections, an impeller housing 14 and a confusor housing 16 having impeller 33 and diffuser 35. Impeller housing 14 is cylindrical with generally uniform diameter at the inlet port 24 and discharge port 26. Confusor housing 16 is cylindrical with an inside surface tapered inwardly from a maximum diameter adjacent the impeller section I to a minimum diameter adjacent the discharge section D. Convergent inside surface 39 of confusor housing 16 has an outlet 28 cross-sectional area preferably proportional to the impeller section intake 24 cross-sectional area at a ratio varying from about 0.5 to 0.75:1, preferably at a ratio of about 0.60 to about 0.70:1 and optimally about 0.64:1 so that volumetric displacement of confusor section is less than volumetric displacement of impeller section. Volumetric displacement of confusor section is from about 75 to about 90 percent of the volumetric displacement of the impeller section, preferably from about 80 to about 90 percent of the volumetric displacement of the impeller section and optimally about 85 percent. Furthermore, the annular flow channel provided by the axial impeller/confusor hub combination in impeller housing 31 has smooth substantially contiguous inner and outer surfaces for preventing turbulent boundary eddies. An important design criterion of impeller section P is that the cross-sectional area of the impeller housing 14 and confusor housing 16 should be the same at the junction point 26.

Figure 16:
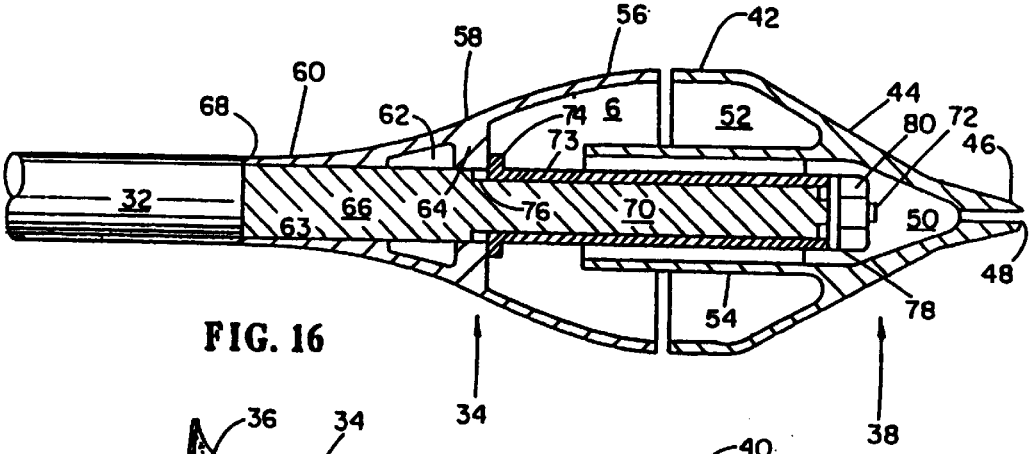
FIG. 16 is a view of a dual hub assembly in longitudinal cross-section.

With particular regard individual parts of impeller section P, the impeller assembly 33 has a unique design having previously undergone much testing and modifications as to both shape of a hub portion 34 and impeller blades 36, see FIGS. 10–12, 14, 16–21. An essential aspect of impeller 33 is that impeller blades 36 are hollow faced blade sections fixed along an outwardly tapered convex surface 58 of the hub portion 34 as seen in FIG. 16, rather than a flat section as is typical in the prior art impeller design.

Figure 14:
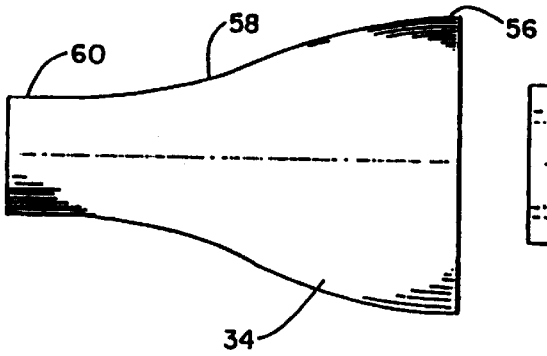
FIG. 14 is an axial view of the rotating hub.

Referring to FIGS. 14 and 16, impeller hub 34 preferably has a convex surface and annular interior, more preferably, hub 34 has an outer surface comprising a concave portion with a narrow diameter leading end 60, an increasing variable diameter mid-portion 58 and a convex portion with a large diameter trailing end 56 (when viewed in axial cross-section) and an annular interior. The overall shape of the impeller hub 34 is designed to maintain the converging volumetric relationship in the annular space established within the cylindrical impeller housing 14 begun in the intake section of the present invention propulsion unit and compensate for the volume displaced by the impeller blades 36. Distal end 66 of shaft 32 extends through a concentric axial bore 63 the length of hub 34. Leading end 60 has an annular end surface abutting a shoulder 68 on shaft 32 to present a smooth, continuous surface for fluid flow. Annular walls of hub 34 formed by concentric annular cavities 65 and 62 are substantially of constant thickness except for a distal annular end 64 extending outwardly from bore 63 providing an engagable surface for a locking sheath 73.

As seen in FIGS. 10–12 and 17–21, impeller 33 has hollow faced section blades 36 attached along the contoured surface of hub 34 at an inclination designed to maximize blade exposure to the passing fluid and reduce radial acceeration component imparted by impeller 33.

Figure 18:
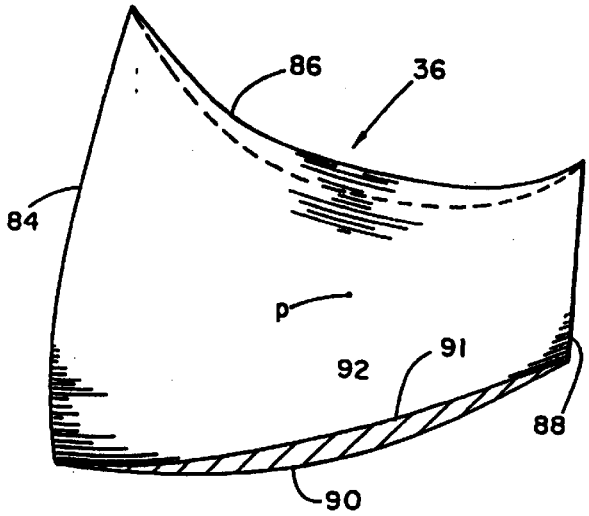
FIG. 18 is a side perspective surface view of an impeller blade.

Blades 36, referring to FIG. 18, preferably have a convex outer radius 90, a concave inner radius 86, a short trailing 88, a long leading edge 84, broad surface sides 92 having a midpoint p, and thickness 91.

Figure 17:
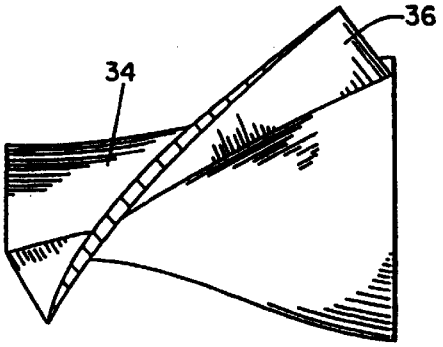
FIG. 17 is a side perspective view of the impeller assembly of FIG. 12 showing one impeller blade attached.
Figure 20:
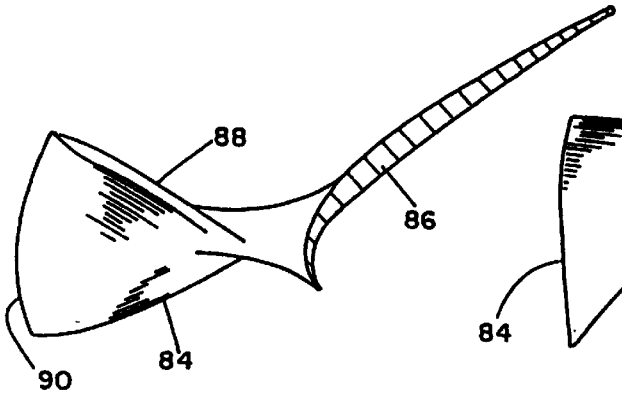
FIG. 20 is a planar perspective view along an edge of the impeller blade showing an inclination in the blade.
Figure 19:
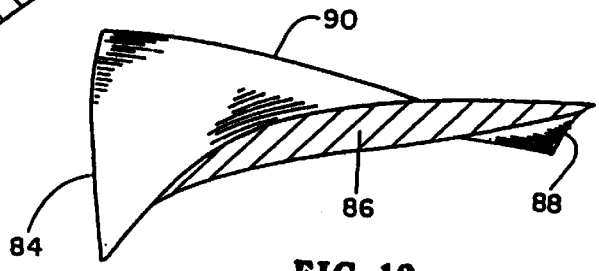
FIG. 19 is a planar perspective view along an inside length of the impeller blade.
Figure 21:
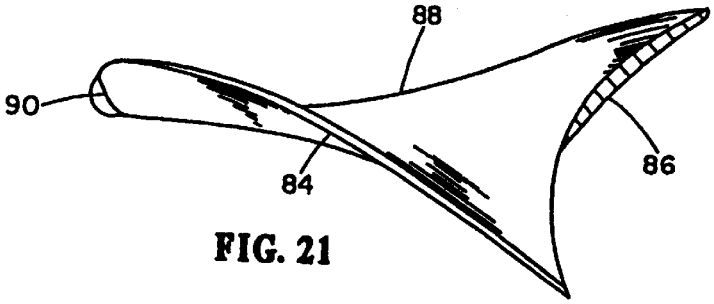
FIG. 21 is a planar perspective view along a second edge of the impeller blade showing the inclination in the impeller blade.

The inclination of impeller blades 36 is defined as an average inclination or degree of twist in the length of blades 36 as determined from the perpendicular with respect to a line tangent to the outer surface of the hub 34 at the leading edge 84 and at the trailing edge 88. When viewed along either the inner radius 86 or outer radius 90 as seen in FIGS. 17–19 or when viewed down either leading or trailing blade edge, as seen in FIGS. 20 and 21, an average angle of inclination of both edge sides is preferably in a range from about 20–40 degrees off the perpendicular, more preferably about 30 degrees off the perpendicular with one edge inclined opposite the other as required by blade 36 to follow hub 34 surface contour. The leading edge is twisted into the direction of the advance of the impeller rotation. It will be appreciated the leading edge 84 corresponds to the leading end 60 of hub 34 which has a narrow diameter and the trailing edge 88 corresponds to the trailing end 56 of hub 34 and that the mid-section radial width of blade 36 is a function of the radius of mid-section portion 58 of hub 34 so that impeller diameter is substantially constant. The overall length of blade 36 is equal to the length of hub 34 plus the angular component.

The blade 36 has a hydrofoil profile in cross-section which minimizes obstruction to flow. In a radial direction the thickness 91 of blade 36 is substantially uniform. Leading or trailing edges 84 and 88 have substantially uniform tapering with a maximum thickness at a midpoint approximately equidistant from either edge.

Figure 10:
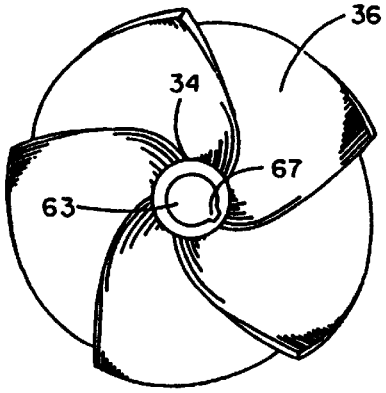
FIG. 10 is a fragmentary perspective view along the lines 10—10 of the unit of FIG. 1 showing the inlet face of an impeller assembly.
Figure 11:
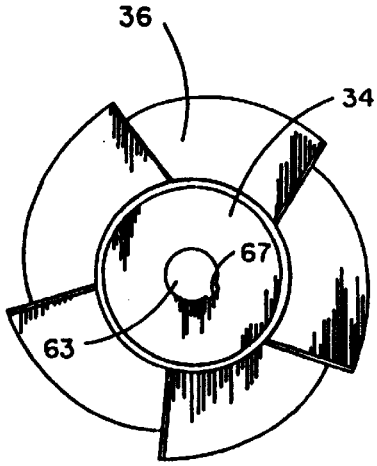
FIG. 11 is a fragmentary perspective view along the lines 11—11 of the unit of FIG. 1 showing the discharge face of the impeller assembly.
Figure 8:
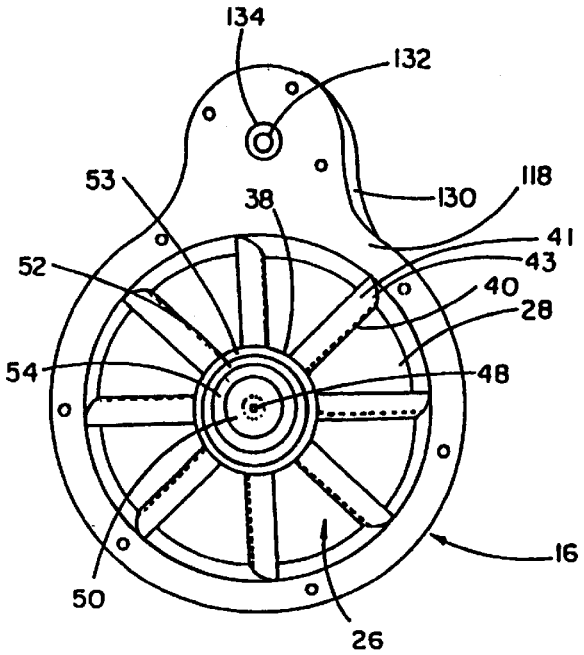
FIG. 8 is a perspective cross-sectional view of the jet propulsion unit in FIG. 1 along the lines 8—8 showing the vane and hub assembly.
Figure 9:
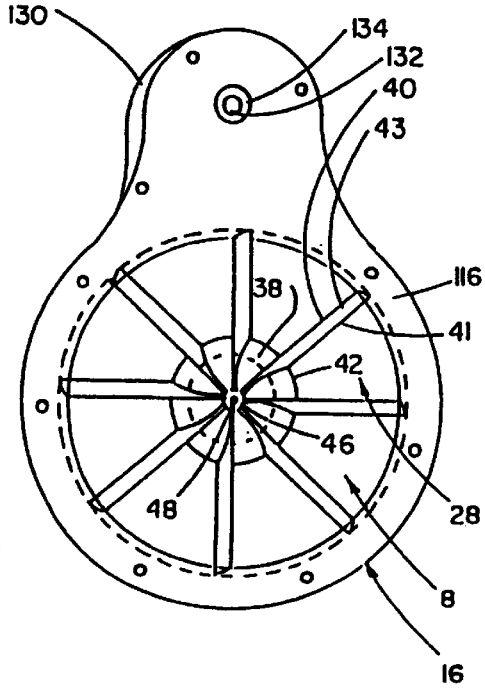
FIG. 9 is a perspective cross-sectional view of the jet propulsion unit of FIG. 1 along the lines 9—9 showing the vane and hub assembly.
Figure 12:
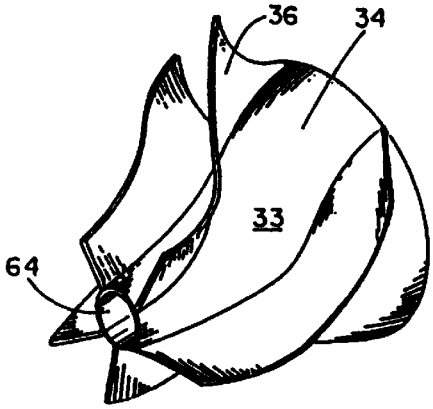
FIG. 12 is an angled perspective view of the impeller assembly.
Figure 13:
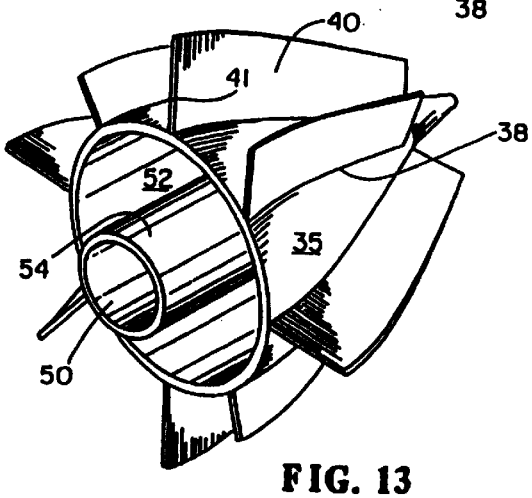
FIG. 13 is a side perspective view of a confusor vane assembly.

FIGS. 10–12 show a typical fan of five blades extending along hub 34, however, the number of blades, impeller diameter and degree of inclination may be optimized in relation to the power supplied by prime mover 13 and design consideration of the vessel at hand.

The confusor 35, as seen in FIG. 2, FIGS. 8 and 9 and FIG. 14, (also sometimes known as a diffuser stator or guide vanes) is disposed immediately adjacent the impeller 33 and is designed to work in conjunction with impeller 33 to achieve several important performance functions: (1) damping a radial acceleration component imparted by the impeller 33; (2) diffusing the path of the water throughput across the entire impeller area cross-section; (3) preventing partial vaporization of the passing fluid resulting from a vacuum associated with impeller action by providing a low artificial back pressure upon impeller 33; and (4) allowing maximum reaction of the impeller and permitting more efficient transfer of the prime movers available energy. Any degree of vapor present would introduce uneven loading on impeller 33 and cavitation.

Figure 15:
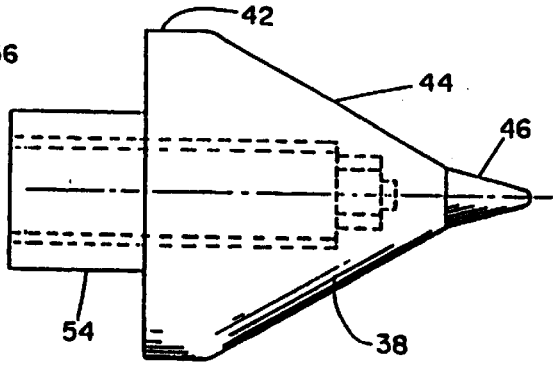
FIG. 15 is an axial view of the stationary hub.

The confusor hub 38 as seen in FIGS. 15-16, has preferably an inwardly tapered convex surface and annular interior oppositely disposed in relation to hub 34. Hub 38 comprises a large flat diameter leading end 42, decreasing variable diameter mid-section 44 and a small diameter trailing end 46 forming a rounded nose with a concentric bore 48 drilled through the middle thereof and a central annular end extension 54. The overall shape of the confusor hub 38 is designed to maintain the converging volumetric relationship in the annular space established within the diffuser housing 16 begun in the intake section and continued in the impeller housing of the present invention propulsion unit. Concentric outer annular cavity 52 is primarily for reduction of excess weight providing hub 38 with walls of substantially constant thickness. Concentric inner annular bore 50 through extended portion 54 defines a cylindrical housing for bearing 82. Bore 50 has a reduced diameter in the nose section 46 of hub 38 as required by design strength criteria.

The confusor blade design is typically based upon standard straight vane design except for significant changes incorporated into vanes 40 associated with the surface contour of diffuser hub 38. The vanes 40 have a radial width which is a function of a diameter of hub 38 so that the diffuser 35 has a constant diameter. The thickness of each blade may be hydrofoil shaped or typically may have uniform thickness throughout except for an edge side which may be squared or sharpened as design fine-tuning requires. Vanes 40 have a leading edge 41 which is curved in a direction opposite the directional advance of the impeller 33 and a straight section which is typically perpendicular to the hub surface, yet may also be inclined at an angle of up to about 10 degrees off an orthogonal plane bisecting the hub at point of juncture and opposite the directional advance of the impeller 33 depending on performance fine-tuning. Curved end 41 is typically inclined at an angle of about 10 to about 40 degrees off a longitudinal plane bisecting the hub and incorporating straight portion 43. The vanes 40 are securely affixed lengthwise on one end to the contour surface of hub 38 and on the other to the inside walls of housing 16 and provide girding support for the bearing function of hub 38. The number of diffuser vanes is selected with respect to the number of impeller blades in such a relation that performance criteria of the diffuser section e.g. provides backpressure and damping of radial acceleration are achieved and that resonance and noise levels are minimized. In an important design feature, the ratio of impellers to confusor is odd:even or vice versa. For example, given 3, 5, or 7 impeller blades the corresponding number of diffuser vanes would preferably be 4, 8, or 10.

Overall, the diffuser is designed to control the shape of water flow and corresponding acceleration over a large pressure differential presented by a wide range of vessel speeds, maneuvers and sea conditions.

The impeller assembly P, as seem in FIG. 1, is axially symmetrically disposed in the cylindrical impeller housing 31 with the diffuser apparatus 35 attached rearward of the impeller apparatus 33 in close proximity. The outer surface of trailing end 56 on rotatable hub 34 is substantially continuous with the outside surface of leading end 42 on fixed hub 38 as seen in FIG. 16. Impeller assembly P is so arranged to make this assembly simple and quick to remove for maintenance or replace to enable mating of the impeller and matched diffuser to prime mover 13 and craft design requirements. Impeller housing 14 may have a replaceable wear sleeve 170 enabling the diameter of housing 14 be reduced corresponding to reduction of impeller 33 diameter. Thus a smaller diameter impeller arrangement can be used for smaller boats. There is, however, no limitation regarding HP or vessel size and unit 11 may have proportionally expanded capacity for large ships or for greater speeds.

Impeller shaft 32 extending axially through unit 11 is provided with a first bearing support by bearing assembly 140 mounted on inlet housing 12 and a second bearing support at fixed hub 38. Bearing assembly 140 includes housing 142, roller bearing 144 and locking ring 146. Bearing assembly 140 may also include a gear housing (not shown) for unit gearing to a particular prime mover requirement.

Shaft 32, as seen in FIG. 16, is provided with a shoulder 68 and a concentric distal section 66 which has progressively smaller concentric diameter sections 70 and 72. Impeller 33 slides onto section 66 of shaft 32 so that the annular end of leading edge 60 on hub 34 abuts shoulder 68 to present a smooth continuous surface for fluid flow. An annular locking sleeve 73 with a proximal annular end 74 having greater diameter than a minimal diameter of the distal annular end 64 extending outwardly from hub bore 63 engages the annular end 64 holding impeller 33 securely against shoulder 68 on shaft 32. A washer 78 and locking nut 80 secure sleeve 73. Distal section 72 of shaft 32 is threaded for locking nut 80.

A standard key (not shown) and keyway 67 combination synchronously engage impeller 33 upon shaft 32.

The bearing sleeve 82 is inserted into the center annular portion 54 of hub housing 38. Assembly is completed by inserting shaft portion 70 having the sleeve 73 through bearing 82 so that clearance between hubs 34 and 38 is about ⅛ inch. Bore 48 in the nose end 46 of stationary hub 38 provides an exit for water flushing around the exterior of bearing 82. The bearing 82 is self-lubricating, self-cooling and self-flushing, typical of bearings used in marine application.

A means for joining impeller section casing 14 to intake housing 12 and a nozzle housing 20 to discharge housing 18 comprises identical ring clamps 110 which are tightened by bolts 113 within the clamp fitting over mated flanges 112 affixed to respective sections. The clamp 110 typically comprises two semicircular grooved pieces attached at a hinge 111. Additional joining means comprise matching flange connectors as between impeller housing 14 and confusor housing 16 utilizing flanges 114 and 116 and confusor casing 16 and discharge casing 18 utilizing flanges 118. A preferably rubber seal 115 is utilized in between. Rubber seal 115 is typically an O-ring or gasket.

Design of unit 11 is such that the steering means S with housing 130 sits centrally atop pump housing section 31. Sections of housing 130 are also joined by flanges 114, 116 and 118.

Figure 7:
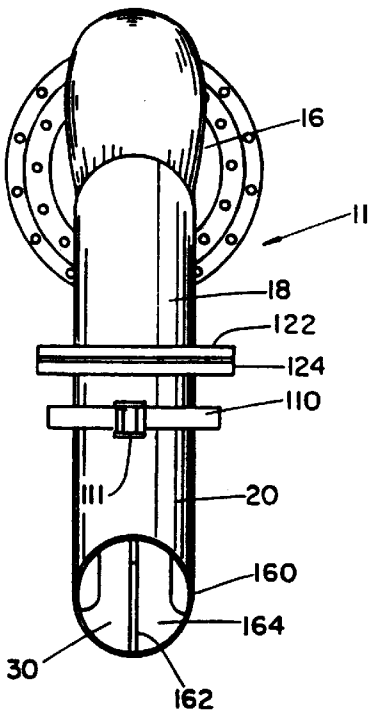
FIG. 7 is a back perspective view of the pump and discharge section of the jet propulsion unit in FIG. 6 along the lines 7—7.
Figure 6:
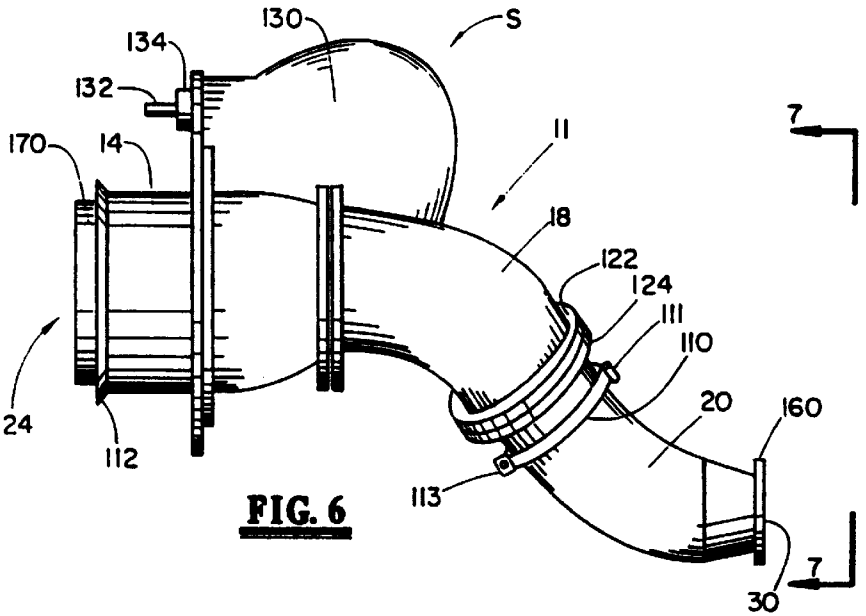
FIG. 6 is a side perspective view of the pump and discharge sections of the jet propulsion unit of the present invention.

As seen in FIGS. 1, 6, and 7, an outlet or discharge section D extending from line C—C to line E–E comprises three cylindrical sections 18, 19 and 20 and provides two primary functions: increase of fluid velocity and a means for swivelably directing the exiting stream to provide control means. Discharge section D incorporates complementocy angles of preferably about 45 to about 60 degrees or as required to horizontally align a discharge point 30 with bottom hull 9 of craft 10.

The first section extending midway out from line C—C is angled cylindrical housing 18. Housing 18 comprises a swivelable portion 19 which is swivelable horizontally through 360 degrees. Swivelable second section 19 and angled section 18 are joined by bearing assembly 120. Bearing assembly 120 comprises inner race 122 attached to the exterior surface of housing 18, outer race 124 attached to the exterior surface of section 19 and bearing ring 121 therebetween.

Steering means S links the steering column 15 in a marine vessel to rotatable section 19 of the jet propulsion unit of the present invention. Steering linkage comprises a steering rod 132 having a sleeve bearings 134 and a first and second angular gear 136. The second angular gear 136 mounted atop a steering rod 138 angularly extending into the interior of housing 18 is operatively associated with rotating section 19 by means of spoke vanes 137. The steering rod 138 has a sleeve bearing 135. Angle spoke vanes 137 are designed and installed so as not to present an impediment to flow.

The third section of discharge D is complementary angled housing 20 clamped to section 19 as mentioned previously and extending out to line E—E. Housing 20 includes a nozzle 21 and is designed to be interchangeable to enable performance guided selection of the nozzle 21. Alternatively, the nozzle 21 can have a variable outlet orifice for fine tuning flow velocities and maximizing output efficiencies by incorporating, for example, an iris type mechanism (not shown). The cross-sectional area at nozzle outlet 30 in discharge section D is preferably proportional to impeller inlet 24 cross-sectional area at a ratio from about 0.25 to about 0.50:1, preferably a ratio from about 0.30 to about 0.40:1 and optimally about 0.35:1. The actual proportionality used will be indicated by the system's convergence. Interior surfaces of the discharge nozzle 21 are smooth and convergent onto outlet 30 cross-sectional area.

Nozzle 21 includes one or more straightener vanes 162 preferably affixed perpendicularly to the inner surface of section 20. Straightener vanes 162 are designed dampen swirl and enable a steady laminar column of water throughput to be discharged from unit 11. In addition, a ring 160 is attached to the outer edge of the nozzle 21 at the outlet 30. The ring 160 artificially enhances the propulsive reaction of the water being discharged by means of eddies formed around the ring edge to permit a smoother transition of the exiting water.

The discharge section D can also incorporate a trim adjustment mechanism (not shown) for changing the height of the discharge outlet 30 relative to the surface of the water so that running trim of the vessel can be adjusted if necessary. The trim adjustment mechanism preferably comprises overlapping sleeves located in the bend area of either or both of the angled housing sections 18, 20 and means for positioning and locking the sleeves into a set position. Thus, the vertical height of the outlet 30 is proportional to the angle arc in the sections 18 or 20 which can be increased or decreased by adjusting the amount of overlap of the sleeves. The positioning and locking means can be a hydraulic cylinder or a gear mechanism. The trim adjustment mechanism is particularly useful when retrofitting an existing vessel with the unit 11. For a new boat designed to accept the propulsion unit 11, a trim adjusting ability is generally unnecessary.

Discharge housing 18 also includes a bleeder hole 174 bored approximately in line with the end of diffuser hub 38 so that trapped air introduced into unit 11 may escape and unit 11 be self-priming.

The control function of discharge section D is incorporated by the directing of nozzle thrust as provided by the steering apparatus S. Directional headings are associated with operation of nozzle 21 in position F, R, and radial positions in between.

As mentioned earlier, superior efficiencies are obtained in the present invention propulsion device by substantially regularly converging the passing water mass on a volumetric basis as exhibited by fluid flow through a regular nozzle or nozzle shaped conduit. That is, the available flow volume per unit length (or alternatively axial cross-sectional flow area) preferably substantially regularly decreases from the inlet 22 to the outlet 30. The flow volume per unit length of the tunnel is defined as the volume of the tunnel minus the volume displaced by the mass of the internal parts (e. g. impeller, diffuser, straightener vanes, shaft, etc.) per unit length. Thus, the tunnel passage has a nozzle type flow characteristic. In a preferred embodiment, the unit flow volume of the propulsion device 11 substantially regularly decreases in the manner of a regular nozzle or nozzle shaped conduit having a convergence (reduction) angle of from about 2 to about 15 degrees, and preferably from about 5 to about 10 degrees. By nozzle shaped conduit it is meant a conduit of overall convergence flow made up of one or more cylindrical and/or nozzle shaped sections wherein the convergence angle of the individual nozzle sections can be different as, for example, a nozzle conduit made up of a first section having a convergence angle of 10°, a second section having a convergence angle of 5°, a cylindrical third section and a fourth section having a convergence angle of 10°.

The marine ducted propeller jet propulsion unit of the present invention is preferably fabricated and assembled from stainless steel chosen for its strength and resistance to corrosion properties, however, a noncorroding engineering plastic having good cohesive strength would also be suitable for one or more parts of the propulsion unit.

It will be appreciated that the performance of the marine ducted propeller jet propulsion unit 11 is dependent upon the synergistic interrelation of the function of each individual section. Each individual section must be manufactured and assembled proportionally and symmetrically with consideration given to required pressure and flow balance needed to permit the jet propulsion unit to function efficiently.

Predictability of performance in regards to the power requirements of the jet propulsion unit enables the unit to be fine-tuned to a particular prime mover respecting design criteria of the impeller blades, associated confusor vanes and nozzle.

The foregoing description of the invention is illustrative and explanatory thereof. Various changes in the materials, apparatus, and particular parts employed will occur to those skilled in the art. It is intended that all such variations within the scope and spirit of the appended claims be embraced thereby.

What is claimed is:

1. A ducted propeller propulsion unit for marine craft, comprising:

a duct forming a continuously converging passage on a volumetric basis from an inlet opening to a discharge nozzle so that water flow received at said inlet is focused at said nozzle into a condensed water vector;

an energy imparting impeller concentrically disposed in said duct comprising impeller blades radially spaced on a rotatable hub forming a first annular passage in the duct, wherein said rotatable hub has an outer surface when viewed in axial cross-section which comprises a concave portion and a convex portion, and an outer diameter increasing from a minimum to a maximum in the direction of flow, wherein a volumetric displacement of said impeller converges the flow through the first annular passage; and a flow straightening confusor concentrically disposed in said duct adjacent said impeller comprising a fixed hub having radially spaced vanes forming a second annular passage, wherein a volumetric displacement of said confusor converges said water flow through said second annular passage to continuously increase velocity of said flow therethrough.

2. The propulsion unit of claim 1, further comprising an inside wall of said second annular passage tapered inwardly from a maximum diameter to a minimum diameter in the direction of flow.

3. The propulsion unit of claim 1, wherein said fixed hub has a convex outside surface tapered inwardly to a distal terminus in the direction of flow.

4. The propulsion unit of claim 1, wherein said nozzle is rotatable through 360° with respect to said inlet.

5. The propulsion unit of claim 1, wherein said duct includes an arm-hole opening upstream of said impeller and a removable plug having an outer flange and an inner core end, said core end having a contoured surface corresponding to a wall of said duct to present a generally smooth continuous surface to the fluid flow.

6. The propulsion unit of claim 2, wherein a transverse inlet cross-sectional area of said duct is proportional to an inlet cross-sectional area of said first annular passage at a ratio of from about 1.5 to about 2.5:1.

7. The propulsion unit of claim 6, wherein an outlet cross-sectional area of said second annular passage is proportional to an inlet cross-sectional area of said first annular passage at a ratio of from about 0.50 to about 0.75:1.

8. The propulsion unit of claim 1, wherein a bypass valve is positioned upstream of said impeller for inhibiting balling.

9. The propulsion unit of claim 7, wherein an outlet cross-sectional area of said nozzle is proportional to an inlet cross-sectional area of said first annular passage to a ratio of from about 0.25 to about 0.50:1.

10. The propulsion unit of claim 1, wherein said nozzle is aligned to a craft hull and said water vector is discharged at or below the water line of the craft.

11. The propulsion unit of claim 1, wherein said nozzle is attached to said duct by a discharge pipe having a substantially constant diameter and wherein said discharge pipe has a greater length than said nozzle.

12. The propulsion unit of claim 1, wherein the discharge pipe has a ratio of length to diameter greater than 1.

13. A ducted propeller propulsion unit for marine craft, comprising:

a duct forming a continuously converging passage on a volumetric basis from an inlet opening to a discharge nozzle so that water flow received at said inlet is focused at said nozzle into a condensed water vector wherein said nozzle is attached to said duct by a discharge pipe having a substantially constant diameter and wherein said discharge pipe has a greater length than said nozzle;

an energy imparting impeller concentrically disposed in said duct, comprising impeller blades radially spaced on a rotatable hub forming a first annular passage in the duct, wherein a volumetric displacement of said impeller converges the flow through the first annular passage; and a flow straightening confusor concentrically disposed in said duct adjacent said impeller comprising a fixed hub having radially spaced vanes forming a second annular passage, wherein a volumetric displacement of said confusor converges said water flow through said second annular passage to continuously increase velocity of said flow therethrough.

14. The propulsion unit of claim 13, wherein said rotatable hub has an outer surface when viewed in axial cross-section which comprises a concave portion and a convex portion, and an outer diameter increasing from a minimum to a maximum in the direction of flow.

15. The propulsion unit of claim 13, further comprising an inside wall of said second annular passage tapered inwardly from a maximum diameter to a minimum diameter in the direction of flow.

16. The propulsion unit of claim 13, wherein said fixed hub has a convex outside surface tapered inwardly to a distal terminus in the direction of flow.

17. The propulsion unit of claim 13, wherein said nozzle is rotatable through 360° with respect to said inlet.

18. The propulsion unit of claim 13, wherein said duct includes an arm-hole opening upstream of said impeller and a removable plug having an outer flange and an inner core end, said core end having a contoured surface corresponding to a wall of said duct to present a generally smooth continuous surface to the fluid flow.

19. The propulsion unit of claim 15, wherein a transverse inlet cross-sectional area of said duct is proportional to an inlet cross-sectional area of said first annular passage at a ratio of from about 1.5 to about 2.5:1.

20. The propulsion unit of claim 19, wherein an outlet cross-sectional area of said second annular passage is proportional to an inlet cross-sectional area of said first annular passage at a ratio of from about 0.50 to about 0.75:1.

21. The propulsion unit of claim 13, wherein a bypass valve is positioned upstream of said impeller for relieving pressure buildup.

22. The propulsion unit of claim 20, wherein an outlet cross-sectional area of said nozzle is proportional to an inlet cross-sectional area of said first annular passage to a ratio of from about 0.25 to about 0.50:1.

23. The propulsion unit of claim 13, wherein said nozzle is aligned to a craft hull and said water vector is discharged at or below the water line of the craft.

24. The propulsion unit of claim 13, wherein the discharge pipe has a ratio of length to diameter greater than 1.

* * * * *